US006786057B2

(12) United States Patent
Ben Yahia

(10) Patent No.: US 6,786,057 B2
(45) Date of Patent: Sep. 7, 2004

(54) VEHICLE AIR CONDITIONING DEVICE USING A SUPERCRITICAL CYCLE

(75) Inventor: Mohamed Ben Yahia, Paris (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 10/275,809

(22) PCT Filed: Oct. 9, 2001

(86) PCT No.: PCT/FR01/03115

§ 371 (c)(1),
(2), (4) Date: Mar. 14, 2003

(87) PCT Pub. No.: WO02/31416

PCT Pub. Date: Apr. 18, 2002

(65) Prior Publication Data

US 2003/0159452 A1 Aug. 28, 2003

(30) Foreign Application Priority Data

Oct. 12, 2000 (FR) ..... 00 13074

(51) Int. Cl.[7] ..... F25B 41/04

(52) U.S. Cl. ..... 62/222; 62/212; 62/224; 62/225; 62/513

(58) Field of Search ..... 62/222, 513, 113, 62/224, 209, 210, 212

(56) References Cited

U.S. PATENT DOCUMENTS

| | | | | |
|---|---|---|---|---|
| 5,685,160 A | | 11/1997 | Abersfelder et al. | |
| 6,260,367 B1 | * | 7/2001 | Furuya et al. | 62/197 |
| 6,341,496 B1 | * | 1/2002 | Kettner et al. | 62/225 |
| 6,523,360 B2 | * | 2/2003 | Watanabe et al. | 62/204 |

FOREIGN PATENT DOCUMENTS

| | | |
|---|---|---|
| DE | 34 42 169 A1 | 5/1986 |
| DE | 198 29 335 A1 | 2/2000 |
| EP | 1 014 013 A1 | 6/2000 |
| EP | 1 026 459 A1 | 8/2000 |

* cited by examiner

*Primary Examiner*—Marc Norman
(74) *Attorney, Agent, or Firm*—Ronald Courtney

(57) ABSTRACT

An air conditioning unit including an expansion device (4) of the refrigerating fluid loop controlled to set the internal heat exchanger efficiency η, represented by the equation: $\eta = T_{cc}T_{sc}/T_{sr}T_{sct}$, wherein: $T_{cc}T_{sc}$ and $T_{sr}$ are respectively temperatures at the compressor input (1), and at the evaporator output (5) and at the fluid cooler output (2), at a reference value such that the fluid leaves the evaporator in a completely gaseous state and without overheating.

16 Claims, 2 Drawing Sheets

VEHICLE AIR CONDITIONING DEVICE USING A SUPERCRITICAL CYCLE

The invention relates to an air-conditioning unit, especially for the passenger compartment of a vehicle, and to a method of controlling a refrigerant loop in such a unit, said loop containing a compressor suitable for receiving the refrigerant in the gaseous state and for compressing it, a refrigerant cooler suitable for cooling the refrigerant compressed by the compressor, at approximately constant pressure, by transferring heat to a first medium, an expander suitable for lowering the pressure of the refrigerant leaving the refrigerant cooler by taking it at least partly into the liquid state and an evaporator suitable for making the refrigerant in the liquid state coming from the expander pass into the gaseous state, at approximately constant pressure, by removing heat from a second medium in order to cool the space to be air-conditioned, the refrigerant thus vaporized then being sucked up by the compressor, the loop furthermore containing an internal heat exchanger allowing the refrigerant, flowing in a first path of the internal exchanger, between the refrigerant cooler and the expander, to yield heat to the refrigerant flowing in a second path of the internal exchanger, between the evaporator and the compressor.

To avoid the deleterious effects on the environment of the fluorocompounds conventionally used as refrigerants in the air-conditioning of motor vehicles, the use of carbon dioxide $CO_2$ is recommended.

This compound has a relatively low critical pressure, which is exceeded during compression of the refrigerant by the compressor so that the refrigerant is then cooled, without any phase change, by the refrigerant cooler which replaces the condenser of the conventional loop. In the absence of a phase change, only the reduction in the temperature of the refrigerant in the cooler allows thermal energy to be dissipated. Since this dissipation generally takes place in a stream of atmospheric air, it is necessary for the temperature of the refrigerant entering the cooler to be substantially greater than the atmospheric temperature. This is why the internal heat exchanger is used, which allows the refrigerant to be warmed up when it flows between the evaporator and the cooler and allows it to be cooled when it flows between the cooler and the expander.

The efficiency $\eta$ of the internal heat exchanger, represented by equation [1]:

$$\eta = \frac{T_{pi} - T_{eo}}{T_{co} - T_{eo}} \quad [1]$$

in which $T_{pi}$, $T_{eo}$ and $T_{co}$ are the compressor inlet temperature, the evaporator outlet temperature and the cooler outlet temperature respectively, is a decreasing function of the flow rate of refrigerant passing through it, according to equation [2]

$$\eta = a \cdot Q^b \quad [2],$$

a and b being characteristic constants of the internal exchanger.

The foregoing is true only when the internal heat exchanger receives from the evaporator refrigerant entirely in the gaseous state. If, on the contrary, it receives therefrom refrigerant in the liquid state, its efficiency is greatly reduced.

The object of the invention is to optimize the operation of the loop so as to avoid this drawback.

Moreover, in order for the stream of air cooled by the evaporator to be at a uniform temperature, it is necessary for the evaporator not to have an overheating zone, in other words for the refrigerant to vaporize right to the end of its path through the evaporator.

Another object of the invention is to satisfy this condition.

The aim of the invention is especially a method of the kind defined in the introduction and ensures that a first condition likely to reveal the presence of refrigerant in the liquid state in said second path is monitored and that the flow rate of refrigerant in the loop is reduced when said first condition is satisfied.

This mode of regulation, based on a thermodynamic principle, allows the operating conditions of the loop to be rapidly stabilized, without any oscillation. In particular, it avoids the appearance of a cold peak when the vehicle accelerates.

Optional features of the invention, which are complementary or alternative, are given below.

Said first condition consists in that the efficiency $\eta$ of the internal heat exchanger, represented by equation $$\eta = \frac{T_{pi} - T_{eo}}{T_{co} - T_{eo}} \quad [1]$$

in which $T_{pi}$, $T_{eo}$ and $T_{co}$ are the compressor inlet temperature, the evaporator outlet temperature and the cooler outlet temperature respectively, is less than a reference value $\eta_0$.

A second condition likely to reveal the existence of an overheating zone in the evaporator is additionally monitored and the flow rate of the refrigerant in the loop is increased when said second condition is satisfied.

Said second condition consists in that the efficiency $\eta$ as defined in claim 2 is greater than or equal to a reference value $\eta_0$.

The flow rate of the refrigerant is set approximately to the maximum value compatible with an efficiency $\eta$ not less than the reference value.

Whatever the value of the flow rate, the value $\eta_m$, taken by the efficiency $\eta$ when the flow rate is a maximum and when said second path does not contain refrigerant in the liquid state, is adopted as reference value.

For a given value $Q_p$ of the flow rate, the value $\eta_p$, taken by the efficiency $\eta$ when said second path does not contain refrigerant in the liquid state, is adopted as reference value.

The flow rate is set by acting upon the expander.

To evaluate $\eta$ on the basis of equation [1], a value measured by means of a sensor in thermal contact with the refrigerant is used for at least one of said temperatures.

To evaluate $\eta$ on the basis of equation [1], the temperature of a stream of air having swept the evaporator and constituting said second medium is used to represent $T_{eo}$.

$T_{pi}$ is compared with a setpoint value $T_{pi,set}$ such that $$\eta_0 = \frac{T_{pi,set} - T_{eo}}{T_{co} - T_{eo}}$$

and $\eta$ is considered to be less than and greater than the reference value when $T_{pi}$ is less than and greater than said setpoint value, respectively.

The compressor is of the type with a variable swept volume with external control.

The compressor compresses the refrigerant up to a supercritical pressure.

The subject of the invention is also an air-conditioning unit, especially for the passenger compartment of a vehicle, suitable for implementing the method as defined above, comprising a refrigerant loop as defined, monitoring means for monitoring a first condition likely to reveal the presence of refrigerant in the liquid state in said second path and, optionally, a second condition likely to reveal the existence of an overheating zone in the evaporator, and means for controlling the flow rate of the refrigerant in the loop according to the result of this monitoring.

The unit according to the invention may include at least some of the following features:

the monitoring means comprise means for evaluating the temperatures $T_{pi}$, $T_{eo}$ and $T_{co}$ at the compressor inlet, at the evaporator outlet and at the cooler outlet respectively, means for calculating from the latter the efficiency η of the internal heat exchanger on the basis of equation [1]:

$$\eta = \frac{T_{pi} - T_{eo}}{T_{co} - T_{eo}} \quad [1]$$

and means for comparing the efficiency η with a reference value;

means for determining the flow rate of the refrigerant in the loop and for determining said reference value from the flow rate;

the means for evaluating said temperatures comprise at least one temperature sensor in thermal contact with the refrigerant; and the means for evaluating the temperature $T_{eo}$ comprise a temperature sensor in thermal contact with a stream of air having swept the evaporator.

The features and advantages of the invention will be explained in greater detail in the description below, with reference to the appended drawings.

Figure 2:
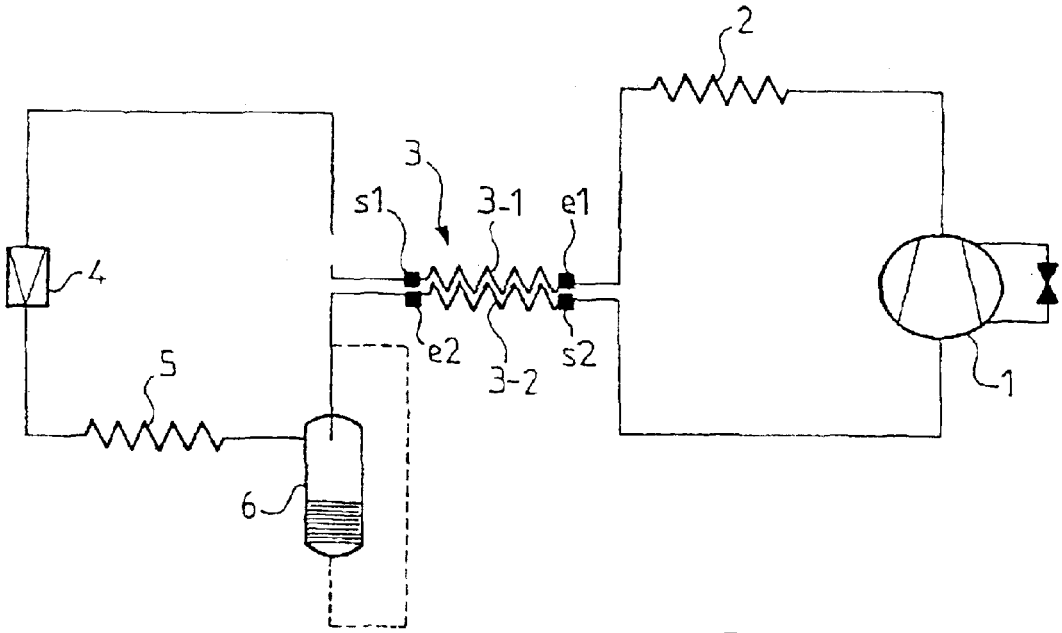
FIG. 2 is a circuit diagram of a refrigerant loop forming part of a unit according to the invention.

FIG. 2 shows the known structure of an air-conditioning loop for the passenger compartment of a motor vehicle using carbon dioxide as refrigerant in a supercritical thermodynamic cycle. A compressor 1 compresses the refrigerant so as to take it into the supercritical state, after which the refrigerant flows through a refrigerant cooler 2. The refrigerant leaving the cooler 2 travels along a path 3-1 of an internal heat exchanger 3 and then passes through an expander 4 before reaching an evaporator 5. Downstream of the evaporator, the refrigerant passes through a tank 6 and then follows a path 3-2 of the internal exchanger 3 before returning to the compressor 1. The paths 3-1 and 3-2 are located side by side in a countercurrent configuration, that is to say the inlet i1 and the outlet o1 of the path 3-1 are adjacent to the outlet o2 and the inlet i2 of the path 3-2, respectively. Under these conditions, an efficiency η of the internal exchanger is defined by equation [1]

$$\eta = \frac{T_{pi} - T_{eo}}{T_{co} - T_{eo}} \quad [1]$$

in which $T_{pi}$, $T_{eo}$ and $T_{co}$ are the refrigerant temperatures at the inlet of the compressor 1 (or at the outlet o2), at the outlet of the evaporator 5 (or at the inlet i2) and at the outlet of the cooler 2 (or at the inlet i1), respectively.

Figure 1:
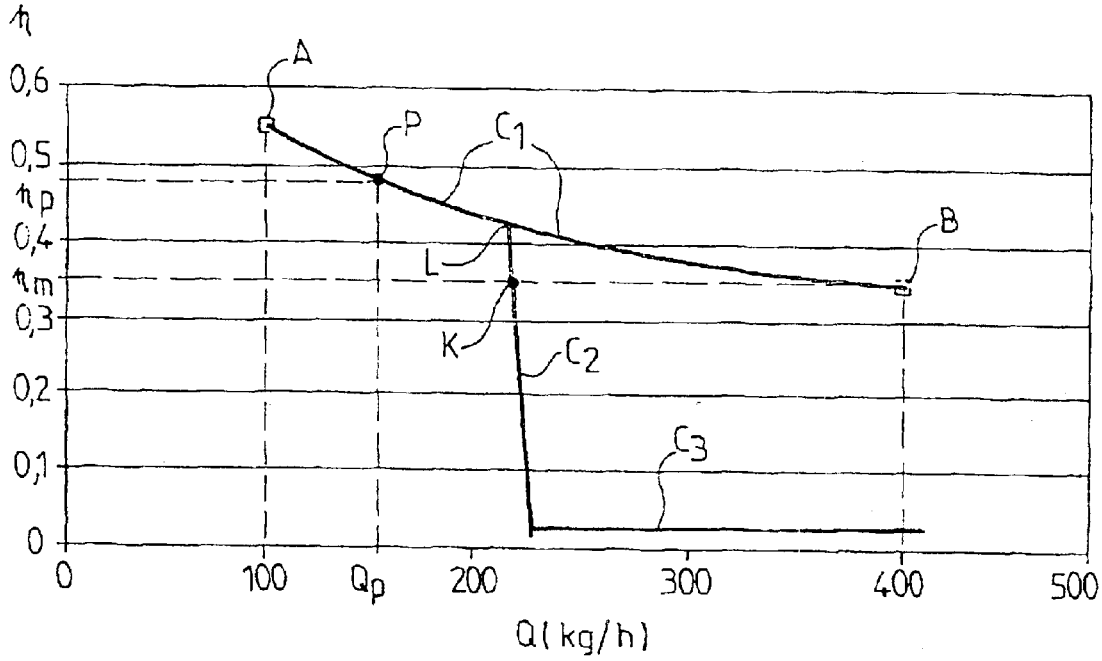
FIG. 1 is a graph showing the variation in the efficiency η as a function of the flow rate Q of the refrigerant, for a typical internal heat exchanger that can be used in the method and in the unit according to the invention.

It should be noted that, when the internal exchanger is coursed exclusively by refrigerant in the gaseous state, the efficiency η is a decreasing function of the mass flow rate Q of the refrigerant in the loop, according to a curve an example of which is shown by curve $C_1$ in FIG. 1. This curve extends from a point A to a point B, these points corresponding to the minimum and maximum flow rates that can be obtained in the loop, respectively. Between them, the curve depends only on the geometrical characteristics of the internal exchanger and on the nature of the refrigerant.

The above condition is satisfied only if the thermal load of the loop is sufficient to allow the evaporator to vaporize all of the refrigerant up to its maximum flow rate. If the opposite is the case, the efficiency follows curve $C_1$ only up to a point L corresponding to the limiting rate of flow that can be vaporized in the evaporator. Above this limiting flow rate, the internal exchanger receives refrigerant from the evaporator in the liquid state, which means that the efficiency suddenly decreases along the approximately vertical curve segment $C_2$ followed by a more or less horizontal segment $C_3$ for which the efficiency is virtually zero.

Figure 3:
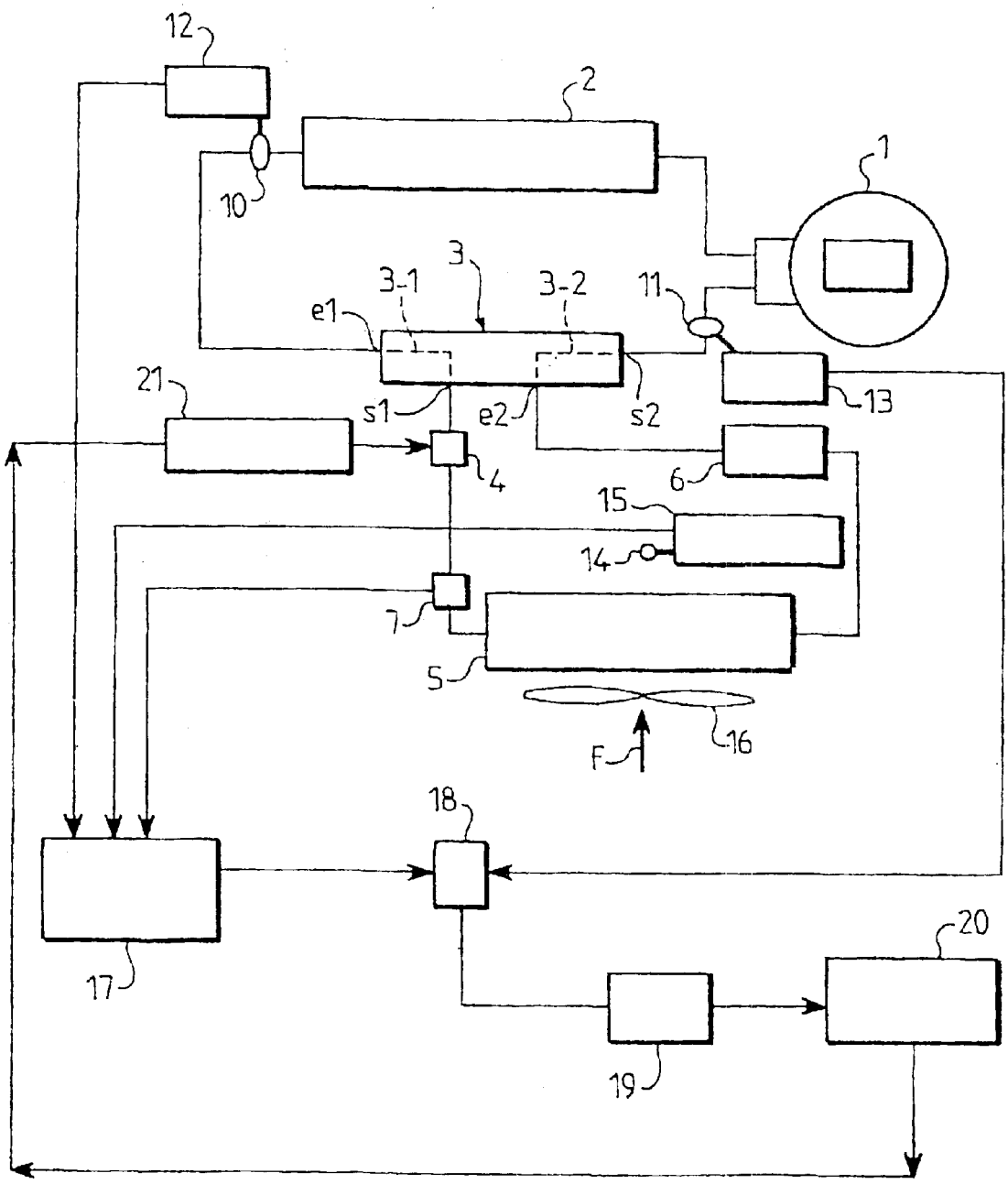
FIG. 3 is a functional diagram illustrating the method and the unit according to the invention.

Shown again in FIG. 3, which represents an air-conditioning unit according to the invention, is the loop of FIG. 2, composed of elements 1 to 6 to which have been added a flow rate sensor 7, placed upstream of the evaporator 5 so as to measure the mass flow rate of the refrigerant which passes through it in the liquid state, and two temperature sensors 10 and 11 associated with respective read devices 12 and 13, intended to measure the temperature of the refrigerant between the outlet of the refrigerant cooler 2 and the inlet i1 of the path 3-1 of the internal exchanger 3, and between the outlet o2 of the path 3-2 of the latter and the inlet of the compressor 1, respectively. Another sensor 14, associated with a read device 15, measures the temperature of a stream of air F after it has passed through the evaporator 5 under the action of a blower 16, this stream of air being intended to be sent into the passenger compartment of the vehicle in order to control the temperature in the latter.

According to the invention, the temperature $T_{co}$ at the outlet of the cooler 2 (or at the inlet i1) and the temperature of the cooled air are sent via the devices 12 and 15 to a processing device 17 respectively, the latter also being connected to the flow rate sensor 7 which calculates, from these measured values—if necessary with a correction in order to take into account the difference between the temperature of the cooled air and the temperature $T_{eo}$ at the outlet of the evaporator 2 (or at the inlet i2)—a setpoint value $T_{pi,set}$ that the temperature $T_{pi}$ of the refrigerant at the inlet of the compressor 1 (or at the outlet o2) should have so that the efficiency η of the internal exchanger 3, calculated according to equation [1], takes a reference value $\eta_p$ equal to the ordinate of the point P on curve $C_1$ which has, as abscissa, the flow rate $Q_p$ measured by the sensor 7. The actual value of $T_{pi}$, delivered by the device 13, is compared with this setpoint value by a comparator 18. If $T_{pi}<T_{pi,set}$, this means that the actual efficiency is less than the reference value and consequently that the point representative of the efficiency on the graph in FIG. 1 lies below curve $C_1$, and therefore on one of the segments $C_2$ and $C_3$, indicating the presence of liquid in the internal exchanger. The comparator 18 then generates an error signal 19 which is transmitted to a regulator 20, which acts on a control device 21 which controls the expander 4 so as to reduce the flow rate.

If on the contrary $T_{pi}=T_{pi,set}$, this means that the internal exchanger contains refrigerant entirely in the gaseous state and that the point representative of the efficiency on the graph in FIG. 1 lies on curve $C_1$. However, this equality does not allow the following three cases to be distinguished: either the representative point is the point L defined above, or the representative point lies to the left of point L, or the point L does not exist, the heat load of the loop being sufficient for the internal exchanger not to receive liquid whatever the flow rate of the refrigerant. If it is desired for the evaporator not to have an overheating zone, or for its overheating zone to be minimal, the expander 4 can then be controlled so as to increase the flow rate by a small increment. This will thus achieve regulation about the point L if it exists and, if the opposite is the case, the flow rate will be stabilized to its maximum value corresponding to the point B, ensuring a minimum overheating zone.

As a variant, the mass flow rate of the refrigerant may be determined by means other than the sensor 7. For example, the volume flow rate of the refrigerant in the compressor may be determined from the swept volume and from the speed of the compressor, and the mass flow rate is deduced therefrom by taking into account the density of the refrigerant, which depends on the nature of the latter, on the temperature and on the pressure.

In another variant, the flow rate of the refrigerant is not taken into account, and the efficiency $\eta$ is compared with a reference value $\eta_m$ equal to the ordinate of point B. The inequality $\eta<\eta_m$ then means that the point representative of the efficiency lies on one of the segments $C_2$ and $C_3$, below the point K of the segment $C_2$ which has as abscissa $\eta_m$, requiring the flow rate to be reduced. If, here again, it is desired to eliminate or minimize the overheating zone of the evaporator, the expander will be controlled so as to maintain the efficiency at the value $\eta_m$, thus achieving regulation about the point K, or taking the operating point to the point B. The flow rate corresponding to the point K is very close to that corresponding to point L.

Of course, instead of calculating a setpoint value $T_{pi,set}$ using the reference value of the efficiency of the internal exchanger, it would be possible to compare the actual efficiency $\eta$ directly with the reference value and produce the error signal on the basis of this comparison. These two procedures are strictly equivalent.

Furthermore, the invention is not limited to monitoring the efficiency of the internal exchanger as indicator of the presence of refrigerant in the liquid state in the first path or of the existence of an overheating zone in the evaporator. These phenomena may be detected by other means, for example by specific sensors assigned to the internal exchanger and/or to the evaporator.

Although the invention has been described in detail in relation to the use of carbon dioxide, it may be advantageously applied with any refrigerant, especially one operating according to a supercritical cycle and requiring an internal heat exchanger.

What is claimed is:

1. A method for controlling a refrigerant loop in an air-conditioning unit, especially for the passenger compartment of a vehicle, said loop containing a compressor (1) suitable for receiving the refrigerant in the gaseous state and for compressing it, a refrigerant cooler (2) suitable for cooling the refrigerant compressed by the compressor, at approximately constant pressure, by transferring heat to a first medium, an expander (4) suitable for lowering the pressure of the refrigerant leaving the refrigerant cooler by taking it at least partly into the liquid state and an evaporator (5) suitable for making the refrigerant in the liquid state coming from the expander pass into the gaseous state, at approximately constant pressure, by removing heat from a second medium in order to cool the space to be air-conditioned, the refrigerant thus vaporized then being sucked up by the compressor, the loop furthermore containing an internal heat exchanger (3) allowing the refrigerant, flowing in a first path (3-1) of the internal exchanger, between the refrigerant cooler and the expander, to yield heat to the refrigerant flowing in a second path (3-2) of the internal exchanger, between the evaporator and the compressor, wherein in that a first condition likely to reveal the presence of refrigerant in the liquid state in said second path is monitored and the flow rate of refrigerant in the loop is reduced when said first condition is satisfied, and in which said first condition consists in that the efficiency $\eta$ of the internal heat exchanger, represented by equation $$\eta = \frac{T_{pi} - T_{eo}}{T_{co} - T_{eo}} \quad [1]$$

in which $T_{pi}$, $T_{eo}$ and $T_{co}$ are the compressor inlet temperature, the evaporator outlet temperature and the cooler outlet temperature respectively, is less than a reference value $\theta_0$.

2. The method as in claim 1, in which a second condition likely to reveal the existence of an overheating zone in the evaporator is additionally monitored and the flow rate of the refrigerant in the loop is increased when said second condition is satisfied.

3. The method as in claim 2, in which said second condition consists in that the efficiency $\eta$ as defined in claim 2 is greater than or equal to a reference value $\eta_0$.

4. The method as in claim 1, in which the flow rate of the refrigerant is set approximately to the maximum value compatible with an efficiency $\eta$ not less than the reference value.

5. The method as in claim 1, in which, whatever the value of the flow rate, the value $\eta_m$, taken by the efficiency $\theta$ when the flow rate is a maximum and when said second path does not contain refrigerant in the liquid state, is adopted as reference value.

6. The method as claimed in claim 1, in which, for a given value $Q_p$, of the flow rate, the value $\eta_p$, taken by the efficiency $\eta$ when said second path does not contain refrigerant in the liquid state, is adopted as reference value.

7. The method as in claim 1, in which the flow rate is set by acting upon the expander.

8. The method as in claim 1, in which, to evaluate $\eta$ on the basis of equation [1], a value measured by means of a sensor (10, 11) in thermal contact with the refrigerant is used for at least one of said temperatures.

9. The method as in claim 1, in which, to evaluate $\eta$ on the basis of equation [1], the temperature of a stream of air (F) having swept the evaporator and constituting said second medium is used to represent $T_{eo}$.

10. The method as in claim 1, in which $T_{pi}$, is compared with a setpoint value $T_{pi,set}$, such that $$\eta_0 = \frac{T_{pi,set} - T_{eo}}{T_{co} - T_{eo}}$$

and $\eta$ is considered to be less than and greater than the reference value when $T_{pi}$ is less than and greater than said setpoint value, respectively.

11. The method as in claim 1, in which the compressor is of the type with a variable swept volume with external control.

12. The method as in claim 1, in which the compressor compresses the refrigerant up to a supercritical pressure.

13. An air-conditioning unit, especially for the passenger compartment of a vehicle, suitable for implementing the method as claimed in one of the preceding claims, comprising a refrigerant loop, said loop containing a compressor (1) suitable for receiving the refrigerant in the gaseous state and for compressing it, a refrigerant cooler (2) suitable for cooling the refrigerant compressed by the compressor, at approximately constant pressure, by transferring heat to a first medium, an expander (4) suitable for lowering the pressure of the refrigerant leaving the refrigerant cooler by taking it at least partly into the liquid state and an evaporator (5) suitable for making the refrigerant in the liquid state coming from the expander pass into the gaseous state, at approximately constant pressure, by removing heat from a second medium in order to cool the space to be air-conditioned, the refrigerant thus vaporized then being sucked up by the compressor, the loop furthermore containing an internal heat exchanger (3) allowing the refrigerant, flowing in a first path (3-1) of the internal exchanger, between the refrigerant cooler and the expander, to yield heat to the refrigerant flowing in a second path (3-2) of the internal exchanger, between the evaporator and the compressor, monitoring means (10–15, 17) for monitoring a first condition likely to reveal the presence of refrigerant in the liquid state in said second path and, optionally, a second condition likely to reveal the existence of an overheating zone in the evaporator, and means (19, 20, 21) for controlling the flow rate of the refrigerant in the loop according to the result of this monitoring, in which the monitoring means comprise means (10–15) for evaluating the temperatures $T_{pi}$, $T_{eo}$ and $T_{co}$ at the compressor inlet, at the evaporator outlet and at the cooler outlet respectively, means (17) for calculating from the latter the efficiency η of the internal heat exchanger on the basis of equation [1]:

$$\eta = \frac{T_{pi} - T_{eo}}{T_{co} - T_{eo}} \quad [1]$$

and means for comparing the efficiency η with a reference value.

14. The unit as claimed in claim 13, which furthermore includes means (7) for determining the flow rate of the refrigerant in the loop and for determining said reference value from the flow rate.

15. The unit as in claim 13, in which the means for evaluating said temperatures comprise at least one temperature sensor (10, 11) in thermal contact with the refrigerant.

16. The unit as in claim 13, in which the means for evaluating the temperature $T_{eo}$ comprise a temperature sensor (14) in thermal contact with a stream of air (F) having swept the evaporator.

* * * * *